US005307728A

United States Patent [19]

Baur

[11] Patent Number: 5,307,728

[45] Date of Patent: May 3, 1994

[54] CONTROL ARRANGEMENT FOR REGULATING THE SPEED OF A PRESSURE CYLINDER

[75] Inventor: Siegfried Baur, Göppingen, Fed. Rep. of Germany

[73] Assignee: L. Schuler GmbH, Fed. Rep. of Germany

[21] Appl. No.: 939,705

[22] Filed: Sep. 2, 1992

[30] Foreign Application Priority Data

Sep. 4, 1991 [DE] Fed. Rep. of Germany ..... 4129367

[51] Int. Cl.[5] ..... F15B 13/04; F15B 11/08

[52] U.S. Cl. ..... 91/31; 91/444; 91/448

[58] Field of Search ..... 91/6, 19, 28, 31, 443, 91/444, 445, 448, 461

[56] References Cited

U.S. PATENT DOCUMENTS

| | | | |
|---|---|---|---|
| 4,192,346 | 3/1980 | Iizumi | 91/443 X |
| 4,647,004 | 3/1987 | Bihlmaier | 91/31 X |
| 4,715,264 | 12/1987 | Stoll | 91/31 X |
| 4,896,594 | 1/1990 | Baur et al. . | |
| 5,184,535 | 2/1993 | Kimura | 91/444 X |

FOREIGN PATENT DOCUMENTS

| | | | |
|---|---|---|---|
| 2700978 | 7/1978 | Fed. Rep. of Germany | 91/31 |
| 1455060 | 1/1989 | U.S.S.R. | 91/444 |

OTHER PUBLICATIONS

Forschung und Konstruktion, Wirkungsweise und konstruktive Besonderheiten von Proportionalventilen, Kurt Kasperbauer, pp. 1177–1180.

*Primary Examiner*—Edward K. Look
*Assistant Examiner*—John Ryznic
*Attorney, Agent, or Firm*—Evenson, McKeown, Edwards & Lenahan

[57] ABSTRACT

A control arrangement for regulating the speed of a pressure cylinder increases the controllable flow volume through a proportional-action (control) valve, while avoiding a larger valve or two valves of the same type that must be connected in parallel. A control valve is used which has at least two flow paths connected in parallel. At least one controllable valve is connected in series with a first of the flow paths for the blocking or release of the delivery pipe. The connected first flow path and the controllable valve are connected in parallel to the second flow path.

3 Claims, 3 Drawing Sheets

CONTROL ARRANGEMENT FOR REGULATING THE SPEED OF A PRESSURE CYLINDER

BACKGROUND AND SUMMARY OF THE INVENTION

The present invention relates to a control arrangement for regulating the speed of a pressure cylinder, particularly of a preacceleration cylinder in a drawing apparatus of the drawing stage of a press. The arrangement has a control valve in the delivery pipe leading to the pressure cylinder which can be adjusted in its cross flow section.

Pistons and piston rods of pressure cylinders must be moved at various and different speeds. The controlling of the speeds takes place by valves which can be changed in their (flow) cross section, for example, by means of proportional-action valves.

The flow characteristics of such valves show that a regulating of the flow (of the flow rate) can take place only within limits, relative to the opening cross section. Ranges of 0% to approximately 30% of the opening cross section and of approximately 60% to 100% of the opening cross section have almost no effect on the regulating or control. After the cross section is increased to, for example, 60%, no significant volume flow increases take place. Lower flow ranges may be regulated by means of one valve; higher flow ranges that can be connected require coupling in parallel. Valves with larger flow cross sections,, in turn, are unsuitable for lower flow ranges. Parallel connections of control valves require high control expenditures also because of the required isochronism of the regulating of the flow cross sections.

Parallel connections have been used, for example, in cases where pressure cylinders must be controlled in rapid motion (high flow volumes) and in one operating cycle (high pressure). See, for example, *Maschinenmarkt,* Würzburg 88 (1982) 57, Page 1177 to 1180.

The German Patent Document DE 36 40 788 A1 discloses a drawing device in a press comprising a preacceleration cylinder. The present invention will be explained in the following by using the pressure cylinder that is shown in this patent document as an example, but the invention is not limited to using this type of cylinder. In the case of drawing devices of the disclosed type, a holding force must be applied for the drawing of a metal sheet. The drawing slide moves the metal sheet and a blank holder against the holding force applied by the drawing device. In addition, forces of the inertia of masses, which occur at the start of the deformation, must be overcome. In this case, forces occur abruptly which are reduced by the preacceleration of the blank holder with the metal sheet resting on it in the drawing direction. The preacceleration is generated via a cylinder which is acted upon by pressure. As a function of the number of strokes of the press, the quantity of hydraulic fluid must be controlled that flows to the pressure cylinder. The pilot control pressure cylinder, which feeds a hydraulic fluid to the preacceleration cylinder in a targeted manner, can be connected with a pressure source by a proportional-action valve. However, in this case, the speed range of the pilot control pressure cylinder is narrowed down by saturation ranges of the proportional-action valve (=30%; 60% to 100%).

It is therefore an object of the invention to provide a control arrangement by which, on the one hand, a larger valve is avoided for the control of a pressure cylinder and by means of which, on the other hand, parallel connections of valves are avoided for a flow volume that is controlled in a targeted manner.

This and other objects are achieved by the present invention which provides a control arrangement for regulating the speed of a pressure cylinder in a drawing apparatus of a drawing stage of a press. This control arrangement has a control valve in a delivery pipe leading to the pressure cylinder. The control valve is adjustable in its flow cross section. The control valve has at least first and second flow paths connected in parallel. At least one controllable valve is connected in series to the first flow path, for blocking or releasing of the first flow path, the thus controllable first flow path and the controllable valve being connected in parallel to the second flow path.

Other objects, advantages and novel features of the present invention will become apparent from the following detailed description of the invention when considered in conjunction with the accompanying drawings.

DETAILED DESCRIPTION OF THE DRAWINGS

Figure 4:
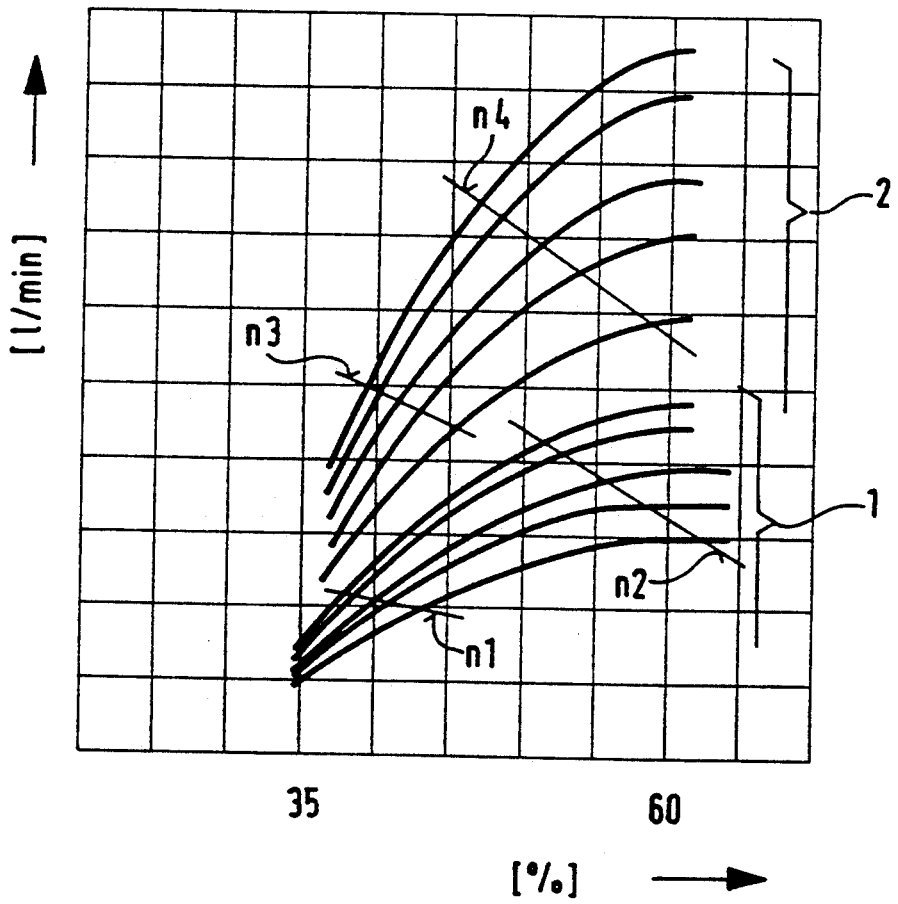
FIG. 4 is a diagram illustrating the possibilities of one-way and two-way flow rate control.

The diagram in FIG. 4 shows that, for the one-way flow rate control as well as for the two-way flow rate control, the ranges between 0% flow cross section and approximately 30% and starting from approximately 60% to 100% are not suitable for control and regulating purposes. In principle, the regulating (control) ranges can be recognized for a single-channel regulating (control) or one-way flow rate control, as can be derived from the state of the art, and for a dual-channel regulating (control) or two-way flow rate control which is an object of the invention. By enlarging the flow cross section, an increase of the flow volume can be achieved. The linears n1, n2 as well as n3, n4 transferred into the regulating (control) ranges point to an increase of the power output of the control arrangement. For example, there is an increase of the speed of the thus regulated pressure cylinder when a switching takes place from a single-channel regulating to a dual-channel regulating.

Figure 1:
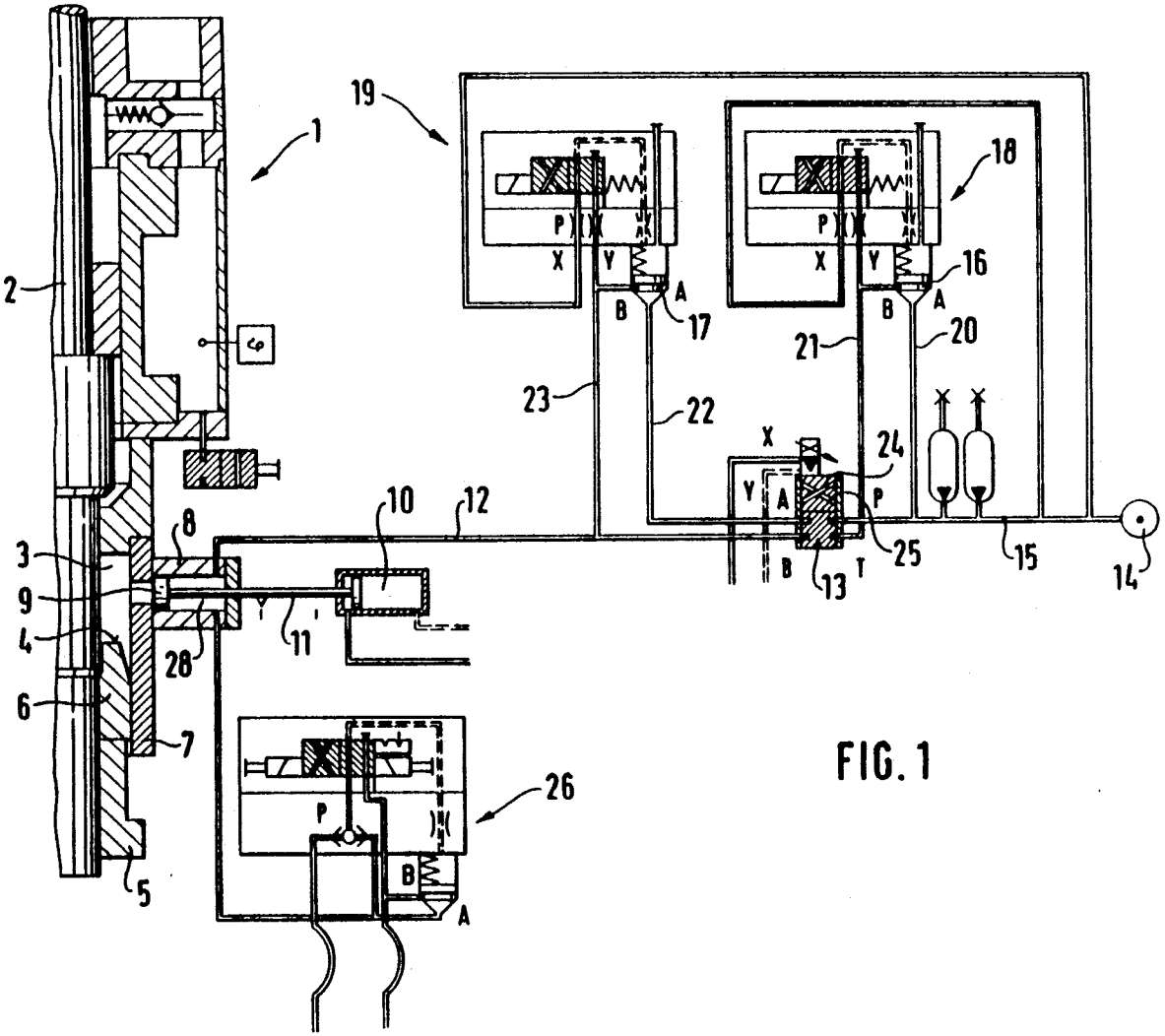
FIG. 1 is a partial view of a prior art drawing device provided with a control arrangement according to an embodiment of the present invention.

FIG. 1 illustrates a control arrangement comprising a proportional-action valve 13 to be used as the control valve whose control piston is controlled in a floating manner; that is, not starting out from stops. Reference number 1 indicates a part of a drawing apparatus of a known type, comprising a piston rod 2 and a pressure piston 6 which can be moved in a preacceleration cylinder 7 when the effective area 4 is acted upon by pressure. When a pressure piston 9 in the pressure space 28 of the volume providing cylinder 8 is acted upon by pressure, a defined volume of hydraulic oil can be fed to the pressure space 3. The pressure space 3 increases as a result of the downward-movement of the pressure piston 6 with the piston rod 2.

The volume of hydraulic fluid displaced from the volume providing cylinder 8 into the pressure space 3 is determined by the piston diameter and the stroke of the piston 9. The speed of the piston 9 is regulated by the filling rate into the pressure space 28. A cylinder 10 with a piston rod 11 is used for the restoring movement of the piston 9 after the actual drawing operation.

The pressure space 28 in the volume providing cylinder 8 can be connected with a pressure source 14 via pressure pipe 12 and pressure pipe 15. A proportional-action valve 13 with two flow paths 24, 25 is connected into the pressure pipes 12, 15. A line 20 to a control valve 16 is connected between the pressure source 14 and the proportional-action valve 13 to the pressure pipe 15 laid to one of the flow paths, in this case 24. The outlet of the control valve 16, in turn, via a pressure pipe 21, is connected to the other flow path 25 of the proportional-action valve 13. The flow path 24 is connected with the pressure space 28 of the volume providing cylinder 8 directly through the pressure pipe 12. The outlet of the flow path 25 on the proportional-action valve 13 is connected, through a pressure pipe 22, to another control valve 17 whose outlet, via a pressure pipe 23, is connected to pressure pipe 12 leading to the volume providing cylinder 8.

Reference numbers 18 and 19 indicate pilot controls of the control valves 16 and 17. The type of the control valves illustrated as well as the pilot controls 18, 19 are exemplary only. The control circuit 26 is used for controlling the discharge from pressure space 28 of the volume providing cylinder 8. The change-over from the single-channel operation for lower rates of flow to the dual-channel operation for higher rates of the flow into the pressure space 28 of the volume providing cylinder 8 therefore takes place via the control of the pilot control valves 18, 19 from the closed into the open control position. In the single-channel operation as well as in the dual channel operation, the flow volume can be regulated between a minimum and a maximum by the proportional-action valve.

When the operation of the drawing apparatus is to be increased to a higher number of ejections of workpieces, because of the control measure, a rise of the flow volume through the proportional-action valve 13 is possible without any change of the flow characteristics of the proportional-action valve 13.

Figure 2:
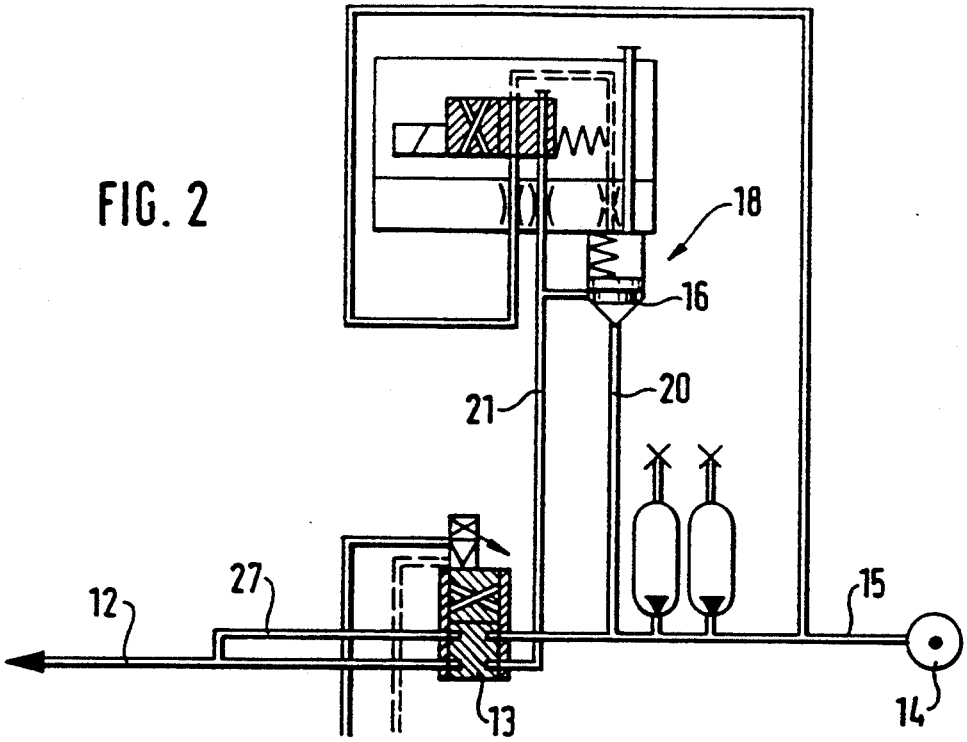
FIG. 2 shows another embodiment of the control arrangement of the present invention.
Figure 3:
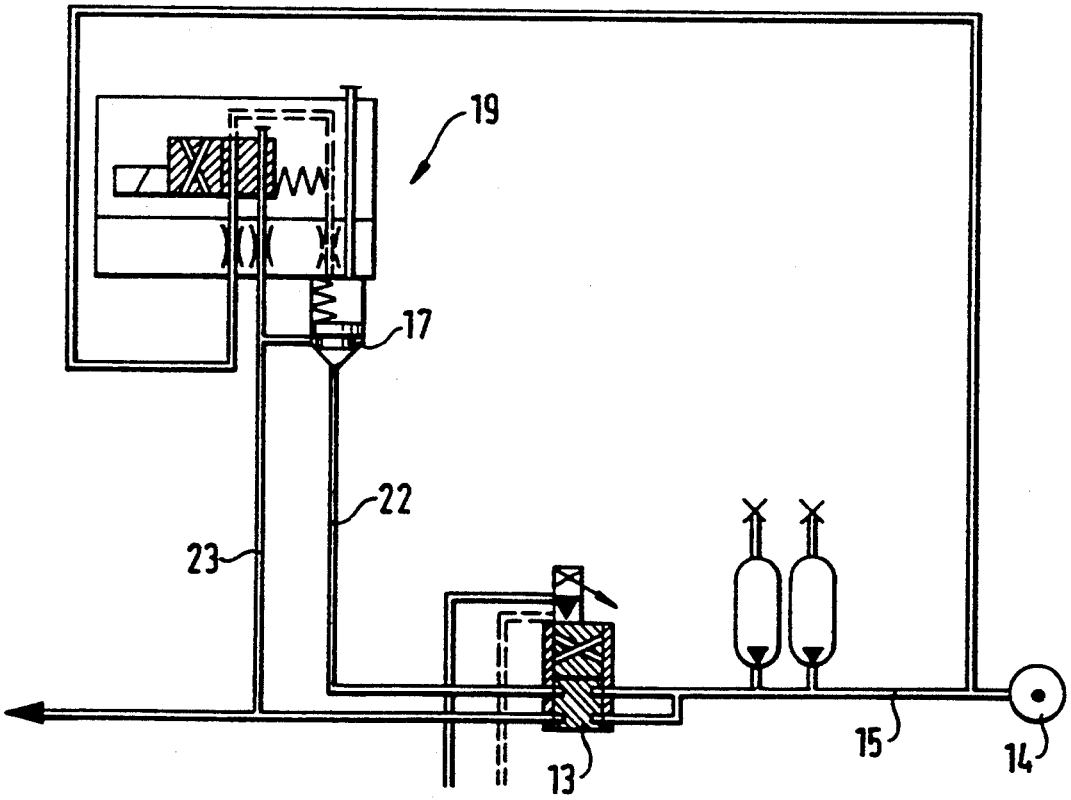
FIG. 3 shows another embodiment of the control arrangement of the present invention.

When the control pistons of such valves 13 are to be started from stop edges, a simplification of the construction of the control arrangement can be achieved by means of a control valve 16 or 17 which is connected in series into the flow path 25, as indicated in the embodiment of FIGS. 2 and 3.

In FIG. 2, a control valve 16 is connected upstream in front of the inlet to the flow path 25. The outlet of flow path 25 is connected to the pressure pipe 12 by way of pressure pipe 27.

In FIG. 3, a control valve 17 is connected downstream with respect to the flow path 25. In this case, the inlet of the flow path 25 is connected to the pressure pipe 15 coming from the pressure source 14.

The construction of the control arrangement exhibits a so-called active control, in the case of which the pressure is generated by a pressure source set to a certain pressure level. In contrast, the invention can also be used, for example, in so-called passive controls. Here also, the drawing apparatus known from the state of the art may be used as an example. In the ejection phase for the workpiece, a regulated run-up is predetermined which, according to the previous construction, was achieved by parallel connections of valves.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A control arrangement for regulating the speed of a pressure cylinder in a drawing apparatus of a drawing stage of a press, comprising:

a control valve in a delivery pipe leading to the pressure cylinder, the control valve being adjustable in its flow cross section, the control valve having at least first and second flow paths connected in parallel;

at least one controllable valve connected in series to the first flow path, for blocking or releasing of the first flow path, the thus controllable first flow path and the at least one controllable valve being connected in parallel to the second flow path.

2. A control arrangement according to claim 1, wherein the controllable valve has an inlet connection and an outlet connection, the inlet connection being connected to the delivery pipe leading to the control valve, and the outlet connection being connected to an inlet connection of the first flow path on the control valve upstream with respect to the control valve.

3. A control arrangement according to claim 1, wherein the controllable valve has an inlet connection and an outlet connection, the inlet connection being connected to an outlet connection of the first flow path on the control valve, and the outlet connection of the controllable valve being connected to the delivery pipe leading to the pressure cylinder downstream with respect to the control valve.

* * * * *